US007644463B1

(12) United States Patent
Crawford et al.

(10) Patent No.: US 7,644,463 B1
(45) Date of Patent: Jan. 12, 2010

(54) SPEAR METHOD FOR RETRIEVABLE PIG

(76) Inventors: James Robert Crawford, 108 Copperwood Crossing, Lafayette, LA (US) 70508; Benton Frederick Baugh, 14626 Oak Bend, Houston, TX (US) 77079

( * ) Notice: Subject to any disclaimer, the term of this patent is extended or adjusted under 35 U.S.C. 154(b) by 0 days.

(21) Appl. No.: 12/231,279

(22) Filed: Sep. 2, 2008

(51) Int. Cl.
*B08B 7/00* (2006.01)

(52) U.S. Cl. ..... 15/104.062; 15/104.001; 15/104.061

(58) Field of Classification Search ..... 15/104.001, 15/104.061, 104.062
See application file for complete search history.

(56) References Cited

U.S. PATENT DOCUMENTS 1,308,409 A 7/1919 Amet
4,069,535 A 1/1978 Cato
6,122,791 A 9/2000 Baugh
6,792,641 B1 9/2004 Laker
7,000,280 B1 2/2006 Knapp
2002/0079107 A1 6/2002 Simpson
2005/0284504 A1* 12/2005 Kinnari et al. ..... 134/22.11

OTHER PUBLICATIONS

U.S. Appl. No. 11/220,286, Benton F. Baugh.

* cited by examiner

*Primary Examiner*—Joseph J Hail, III
*Assistant Examiner*—Shantese McDonald

(57) ABSTRACT

The method of retrieving a pig which is stuck in a pipeline including the steps of piercing the pig, establishing a circulation from the near end to the far end of the pig, gripping the central portion of the pig, and pulling the pig back to the proximate end of the pipeline.

13 Claims, 4 Drawing Sheets

SPEAR METHOD FOR RETRIEVABLE PIG

CROSS REFERENCE TO RELATED PATENT APPLICATIONS

N/A

BACKGROUND OF THE INVENTION

The field of this invention is that of tools used for the cleaning of oil and gas pipelines, especially the long extended reach pipelines in offshore areas. As hot production crude is produced from the reservoirs below the ocean floor up to the wellhead equipment at the ocean floor and then thru pipelines along the ocean floor, it is cooled by the relatively cool temperature of the ocean water. In deepwater, the temperature can be as cold as 35 degrees Fahrenheit.

A characteristic common to a majority of the oil produced is a wax or paraffin component to the oil which will deposit on the walls of the pipeline and become a solid at temperatures well above 35 degrees Fahrenheit. Some of the paraffins are a solid at temperatures above 100 degrees Fahrenheit, and so can be deposited or plated on the internal diameters of the pipelines at any expected ambient temperature. The process is similar to blocking the arteries of a human being, with a thicker coating building up with time. Some pipelines have become so plugged that more than 90% of the flow area is blocked with the waxes or paraffins.

Typically, as the pipeline wall becomes layered with paraffin as the temperature of the oil drops below the solidification temperature of the particular paraffins in the produced fluids. The paraffins act as a sort of insulation to the flow in the pipeline, allowing it to maintain a higher temperature for a greater distance. The effect of this is to extend the distance along the pipeline to which the paraffin is plating onto the internal diameter of the pipeline, therefore increasing the pressure drop and flow rate within the pipeline.

A common cure for the paraffin plating out on the internal diameter of the pipeline is to insert a mechanical cleaning device called a "pig" into the flow stream and let the pig remove some of the paraffin. A pig is typically a cylindrical or spherical tool which will brush against the internal diameter of the pipeline in hopes of removing the deposited paraffins. In pipelines with a high incidence of deposited paraffins, a regular pipeline maintenance program with pigs is normally prescribed as a preventative measure to reduce pipeline blockage.

One problem with using pigs is that deposited paraffins are relatively soft and contain large quantities of oil. To some extent, the pigs actually compress the paraffins against the wall and squeeze the oil out, leaving a harder and stronger paraffin remaining.

A second problem is that when the paraffin layer on the internal diameter of the pipe is too thick, sloughing off may occur. If the paraffin starts to separate from the wall and continues, the pig begins to literally plow a block of paraffin ahead of itself. This will continue driving more and more paraffin off the wall of the pipeline until the pressure within the pipeline will no longer be able to move the mass. At that time the pipeline is fully blocked, and the pig cannot be moved by pressure from either end.

When this happens the plug of paraffin must be removed using chemicals. If access to the downstream end of the plug is available, chemicals can be delivered from that end to break down the blockage. Since the paraffin blockage is downstream of the pig, the chemicals cannot be deployed to the plug from the upstream end of the pipeline. If access is only available from the upstream end, there is no way to remove the pig and allow such delivery of chemicals.

Another problem is that if the pig were to be grasped to be pulled back toward the upstream end, its tendency to seal against the wall would cause hydraulic locking and make the pig difficult to remove. At the surface we are accustomed to pulling a vacuum of 14.7 p.s.i. which would result in a 739 lb. force in an eight inch internal diameter pipeline. In a pipeline in 1000 foot of depth of seawater, the ambient pressure is 465 p.s.i. instead of 14.7 p.s.i., yielding a 23,373 lb. force to overcome instead, effectively vacuum locking the pig in place. The vacuum locking in ocean depths can generate massively high forces to overcome.

SUMMARY OF THE INVENTION

The object of this invention is to provide a method for removing cleaning or inspection pigs from pipelines by penetrating the pig.

A second object of the invention is to provide a method of using the penetration into the pig to provide a communication path from the front to the back of the pig to prevent vacuum locking of the pig.

A third object of the invention is to provide a method of using the penetration to engage the pig in a gripping manner.

Another object of the invention is to provide a method of having the gripping means within the penetrator expand to allow for a more positive gripping action.

DESCRIPTION OF THE PREFERRED EMBODIMENT

Figure 1:
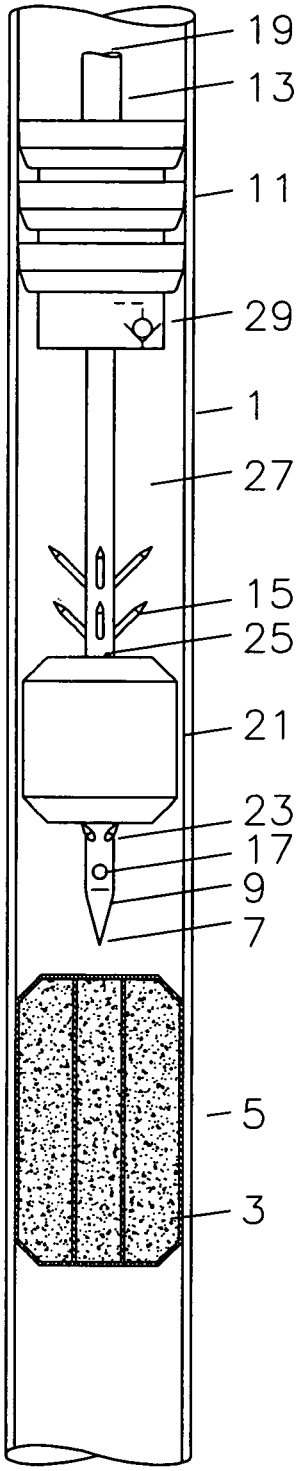
FIG. 1 is a partial section thru the method of this invention showing a spear about to engage a stuck pig.

Referring now to FIG. 1, pipeline 1 is shown with pipeline pig 3 lodged or stuck within the pipeline at a location 5. It may be stuck due to paraffin accumulation, hydrates, or other problems. Point 7 of spear 9 of retrieval pig 10 approaches the pipeline pig 3, being pushed forward by pipeline sealing cups 11 attached to coiled tubing string 13. Spear 9 includes a multiplicity of barbs 15 which will grab the pipeline pig 3 when the spear spears the pipeline pig 3. Circulation hole 17 will allow circulation to and from the interior 19 of coiled tubing string 13 once pipeline pig 3 has been engaged by spear 9. A centralizer bushing 21 is shown spaced near the end of the spear 9 to keep end of the spear 9 centralized prior to stabbing the pipeline pig 3. Barbs 23 are rotated at a different angle that the other barbs to keep the centralizer bushing 21 from falling off the end of the spear 9, as will be seen in FIG. 4. Shear pin 25 keeps the centralizer bushing 21 in it its proper position near the end of the spear 9 until a sufficient force is provided to shear the pin.

Figure 2:
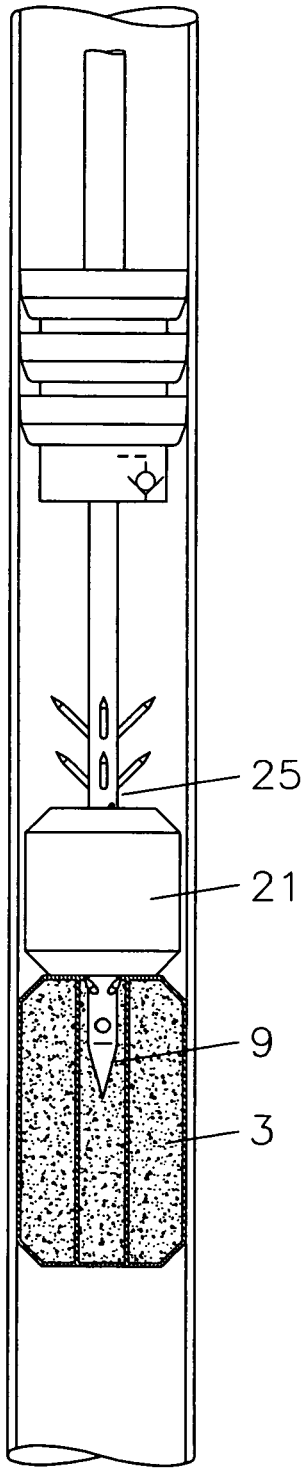
FIG. 2 is a partial section thru the method of this invention showing a spear engaging a stuck pig.

Referring now to FIG. 2, the spear 9 has been moved forward to begin penetrating the pipeline pig 3 and has moved until the centralizer bushing 21 has come into contract with the proximate end of the pipeline pig 3. As the pipeline pig 3 has been moving forward in the pipeline, the fluids in front of the pig have been returned to the location where the retrieval pig 10 was put into the pipeline 1 through circulation hole 17 and the interior 19 of coiled tubing string 13. When the spear 9 of retrieval pig 10 pierces the pipeline pig 3 and circulation hole 17 is blocked, further forward progress of the retrieval pig 10 is stopped as the annular area 27 becomes a fixed volume chamber. Check valve 29 allows the volume of annular area 27 to be vented back into the interior 19 of the coiled tubing string and allows the forward progress of engaging the pipeline pig 3 to continue.

Figure 3:
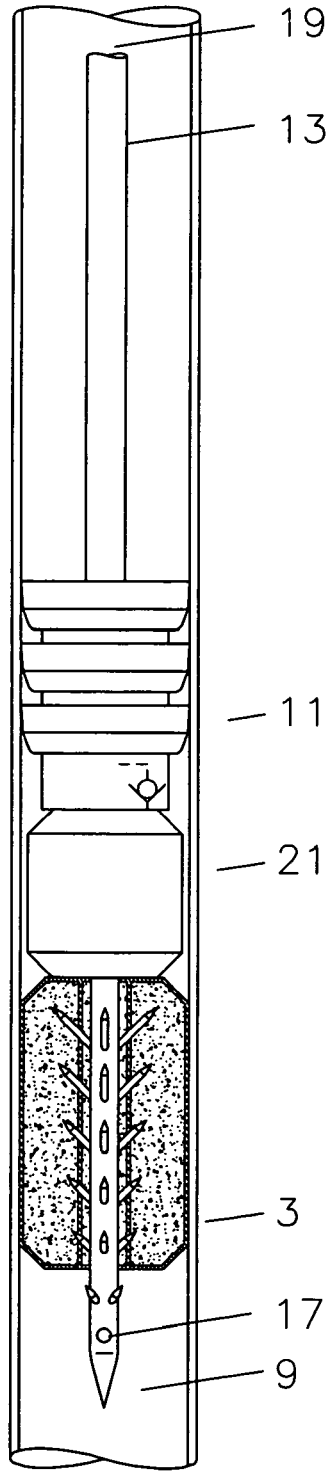
FIG. 3 is a partial section thru the method of this invention showing a spear fully engaged with a stuck pig and recovering the pig.

Referring now to FIG. 3, the spear 9 has continued to penetrate the pipeline pig 3 until it exits on the distal end and the pipeline cups 11 land on the centralizer bushing 21. At this time the circulation hole 17 is in the area on the opposite side or distal end of the pipeline pig 3, allowing communication through the hollow interior of the spear 9 with the interior 19 of the coiled tubing string 13. At this time, a tensile pull on the coiled tubing string 13 will recover the pipeline pig 3, and circulation out circulation port 17 will prevent the area on the distal end of pipeline pig 3 from being effectively vacuum locked.

Figure 4:
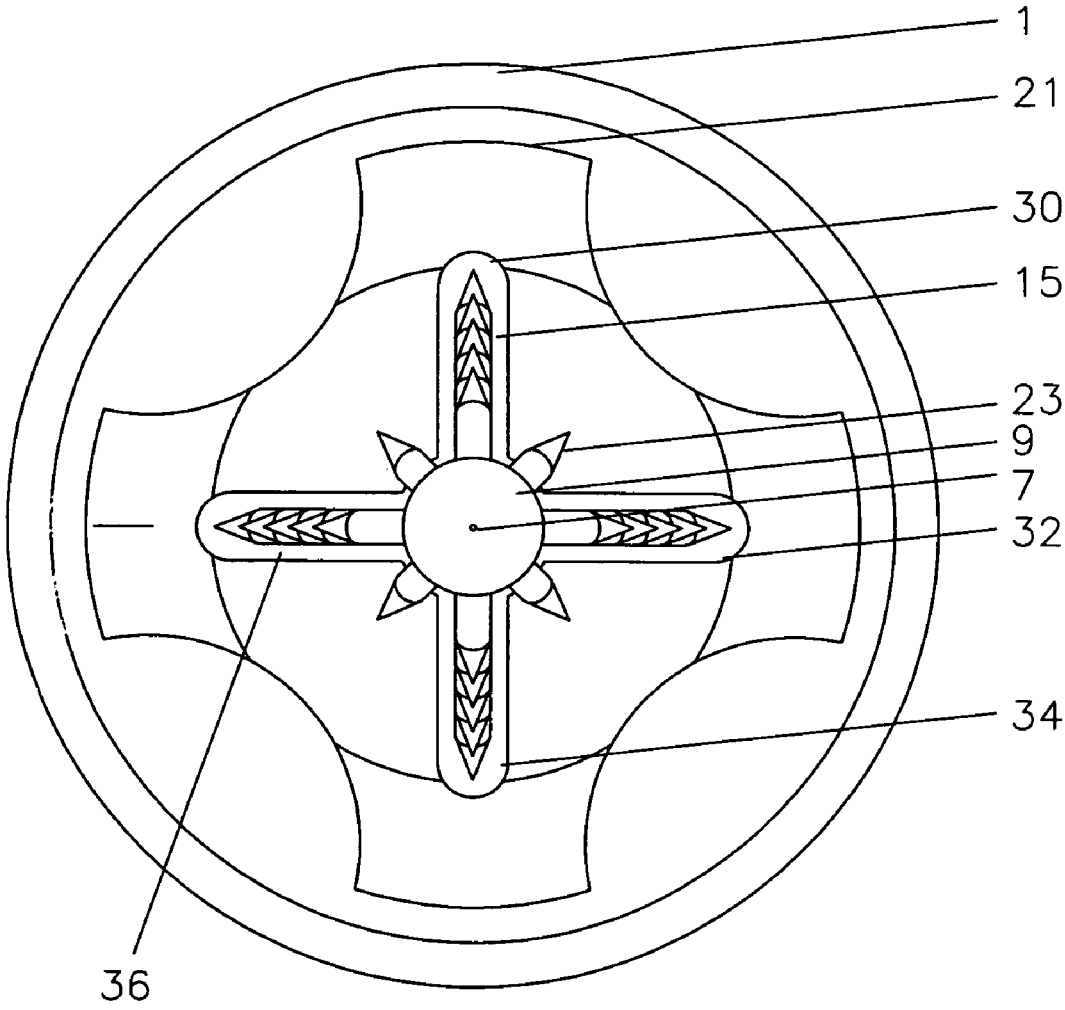
FIG. 4 is a front view of a pig of this invention showing how the centralizing bushing is retained on the pig.

Referring now to FIG. 4, a front view of the spear 9 and centralizing bushing 21 is shown, with slots 30, 32, 34, and 36 allowing free movement of the centralizing bushing 21 with respect to the barbs 15. No comparable slots exist for the barbs 23 which are set at 45 degrees to the barbs 15, preventing the movement of the centralizing bushing 21 off the end of the spear 9.

Figures 5, 6, 7, 8:
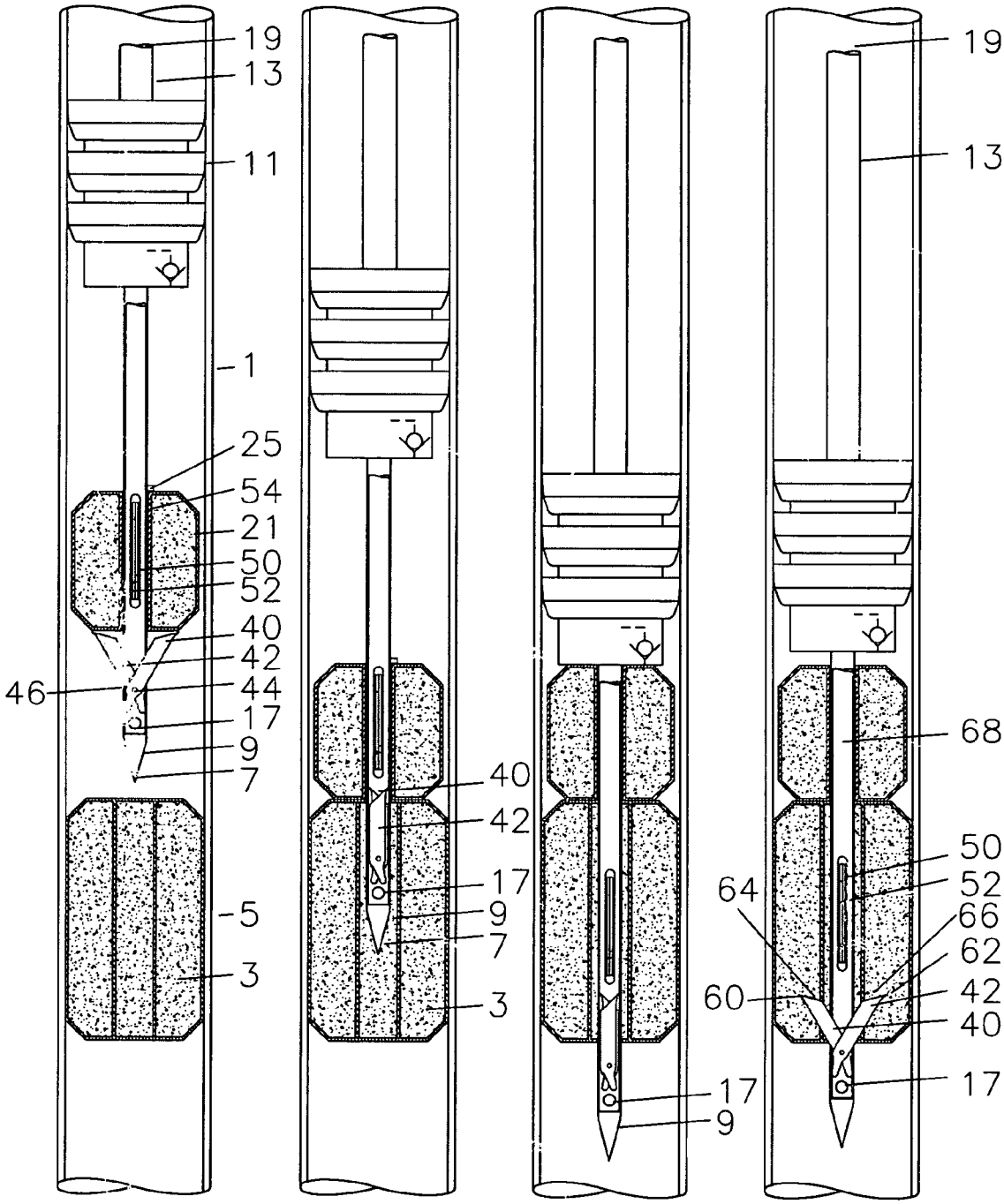
FIG. 5 is a partial section thru the method of this invention showing an expanding spear about to engage a stuck pig.
FIG. 6 is a partial section thru the method of this invention showing an expanding spear engaging a stuck pig.
FIG. 7 is a partial section thru the method of this invention showing an expanding spear fully engaged with the pig.
FIG. 8 is a partial section thru the method of this invention showing an expanding spear fully engaged and recovering the pig.

Referring now to FIG. 5, a different type spear is shown which similar operational characteristics, but has expanding grippers. Grippers 40 and 42 pivot about axle 44 and have spring 46 which urges the two grippers outwardly. In the present position, they are preventing the centralizing bushing from coming off the end of spear 9. Similarly, grippers 50 and 52 are of similar construction, but are mounted rearwardly of grippers 40 and 42 and rotated 90 degrees from the positions of grippers 40 and 42. The inner sleeve 54 of centralizer bushing 21 is keeping grippers 50 and 52 in the retracted position.

Referring now to FIG. 6, the spear 9 has penetrated the pipeline pig 3 up to the point of centralizer bushing 21 engaging the proximate end of the pipeline pig 3. The piercing of the pipeline pig 21 by the spear 9 tends to fold the grippers 40 and 42 down to within the central portion of the spear 9, as is shown.

Referring now to FIG. 7, the spear 9 is completely passed through the pipeline pig 3, with the circulation hole 17 being on the distal end of the pipeline pig 3.

Referring now to FIG. 8, when the coiled tubing string 13 is pulled rearwardly to recover the pipeline pig 3, the sharp ends 60 and 62 of grippers 40 and 42 cause the grippers to flare outwardly and give a large gripping surface along the areas 64 and 66. Grippers 50 and 52 will expand similarly, but it is not obvious on this figure as they are expanding into and out of the page. Circulation port 17 communicates with interior area 68 of the spear 9 and the interior 19 of the coiled tubing string 13.

Figure 9:
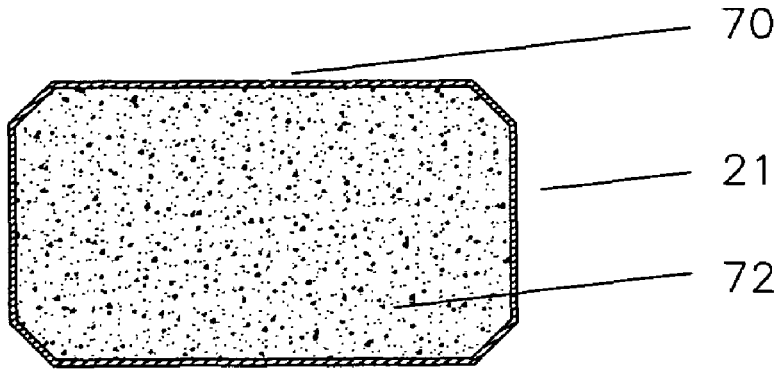
FIG. 9 is a half section of a pig showing a typical construction.

Referring now to FIG. 9, pipeline pig 21 is shown with a typical construction of a hard outer shell 70 and an inner softer or more resilient area 72. This combination provides a outer toughness for wear resistance as the pipeline pig moves along the internal diameter of the pipeline, and a spring like characteristic to keep the pipeline pig rubbing against the internal diameter of the pipeline. The relative toughness of the outer wear resistant area and the inner spongy area will determine the actual grip which can be achieved on the style pig by the methods of this invention.

Figure 10:
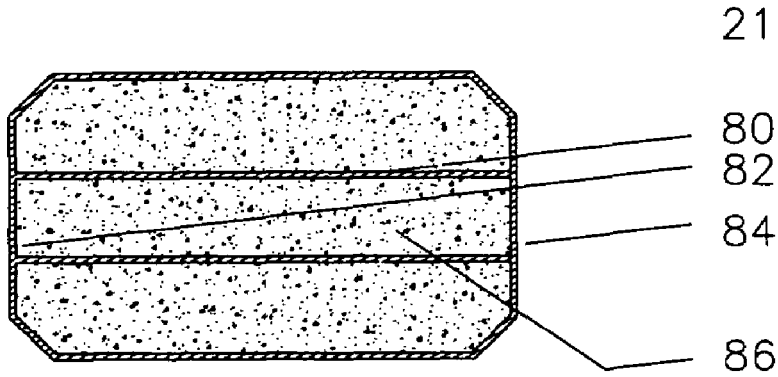
FIG. 10 is a half section of a pig with an inner reinforcing sleeve filled with foam type material.

Referring now to FIG. 10, an internal sleeve 80 has been added to the pig of a stronger material to enhance the gripping force which the spear will have on this pig. Each end are covered by barriers 82 and 84 and the internal area between the barriers is filled with a more resilient material 84.

Figure 11:
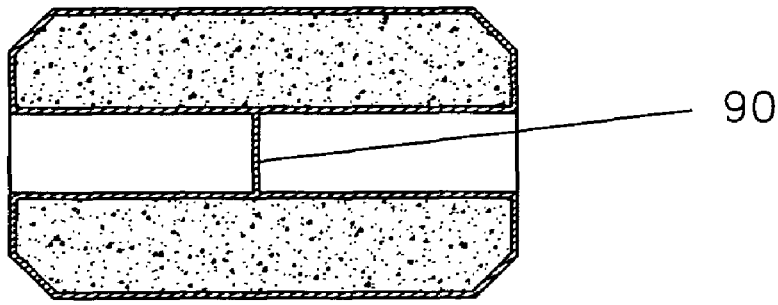
FIG. 11 is a half section of a pig with an inner reinforcing sleeve and a centrally located barrier type bulkhead for piercing.

Referring now to FIG. 11, a pipeline pig is shown having only a single barrier, located centrally of the pipeline pig.

Figure 12:
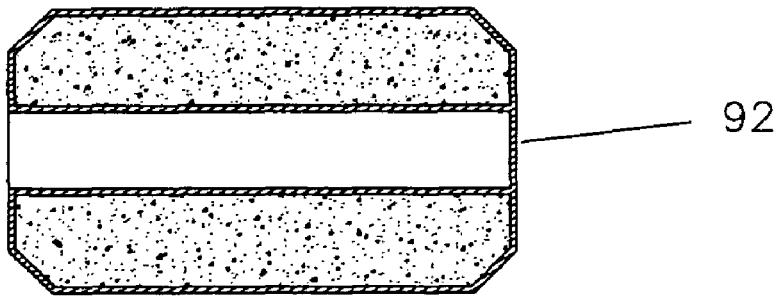
FIG. 12 is a half section of a pig with an inner reinforcing sleeve and a barrier type bulkhead for piercing located at one end of the pig.

Referring now to FIG. 12, a pipeline pig is shown having only a single barrier, located at one end of the pipeline pig.

The pigs primarily discussed herein are cleaning pigs, but similar advantages can be obtained from other pigs, such as an inspection pigs, which might be in the pipeline.

The foregoing disclosure and description of this invention are illustrative and explanatory thereof, and various changes in the size, shape, and materials as well as the details of the illustrated construction may be made without departing from the spirit of the invention.

We claim:

1. The method of retrieving a pipeline pig which has no through bore from a pipeline comprising providing a retrieval pig comprising a spear operable to penetrate through said pipeline pig from the proximate end to the distal end, sealing cups which sealingly engage the bore of said pipeline, a flow path through said retrieval pig, a valve to vent the area between said pipeline pig and said sealing cups into the bore of said retrieval pig but which does not allow flow from said bore of said retrieval pig back into said area between said pipeline pig and said sealing cups, and a gripping area on said spear, providing a tubing string from an entry point into said pipeline to said retrieval pig, deploying said retrieval pig to the location of said pipeline pig, spearing said pipeline pig in order to make a circulation path between the proximate end and the distal end of said pipeline pig, recovering said spear with said pipeline pig attached.

2. The method of claim 1, further comprising said valve is a check valve.

3. The method of claim 1 further comprising providing a multiplicity of barbs as a gripping surface.

4. The method of claim 1 further comprising allowing said griping area to expand when said spear is pulled in the direction of the recovery of said pipeline pig from said pipeline.

5. The method of claim 1 wherein said pipeline pig is a pipeline cleaning pig.

6. The method of claim 1 wherein said pipeline pig is a pipeline inspection pig.

7. The method of retrieving a pipeline pig which has no through bore from a pipeline comprising providing a spear with a flow path through said spear operable to penetrate through said pipeline pig from the proximate end to the distal end, providing a tubing string from an entry point into said pipeline to said spear, providing sealing cups which sealingly engage the bore of said pipeline, deploying said spear to the location of said pipeline pig, spearing through said pipeline pig in order to make a circulation path between the proximate end and the distal end of said pipeline pig, providing a valve to vent the area between said pipeline pig and said sealing cups into the bore of said tubing string but which does not allow flow from said bore of said tubing string back into said area between said pipeline pig and said sealing cups, providing a gripping area on said spear, and recovering said spear with said pipeline pig attached.

8. The method of claim 7, further comprising said valve is a check valve.

9. The method of claim 7, further comprising providing a surface within said pipeline pig for the engagement of said gripping area on said spear.

10. The method of claim 7 further comprising providing a multiplicity of barbs as a gripping surface.

11. The method of claim 7 further comprising allowing said griping area to expand when said spear is pulled in the direction of the recovery of said pipeline pig from said pipeline.

12. The method of claim 7 wherein said pipeline pig is a pipeline cleaning pig.

13. The method of claim 7 wherein said pipeline pig is a pipeline inspection pig.

* * * * *